US006160979A

United States Patent [19]

Shoji

[11] Patent Number: 6,160,979

[45] Date of Patent: Dec. 12, 2000

[54] IMAGE FORMING APPARATUS

[75] Inventor: Hisashi Shoji, Kawasaki, Japan

[73] Assignee: Ricoh Company, Ltd., Tokyo, Japan

[21] Appl. No.: 09/437,339

[22] Filed: Nov. 10, 1999

[30] Foreign Application Priority Data

Nov. 10, 1998 [JP] Japan ..... 10-333388

[51] Int. Cl.[7] ..... G03G 15/09

[52] U.S. Cl. ..... 399/267; 430/122

[58] Field of Search ..... 399/265, 267, 399/272, 276, 277; 430/122

[56] References Cited

U.S. PATENT DOCUMENTS

| | | | |
|---|---|---|---|
| 4,544,618 | 10/1985 | Kopko | 430/122 X |
| 5,311,262 | 5/1994 | Shimizu et al. | 399/276 |
| 5,440,378 | 8/1995 | Matsuura | 399/267 |
| 5,483,329 | 1/1996 | Asanae et al. | 399/267 X |
| 5,565,966 | 10/1996 | Ochiai et al. | 430/122 X |
| 5,915,155 | 6/1999 | Shoji et al. . | |

FOREIGN PATENT DOCUMENTS

| | | |
|---|---|---|
| 61-118767 | 6/1986 | Japan . |
| 3-52870 | 8/1991 | Japan . |
| 4-158373 | 6/1992 | Japan . |
| 5-72905 | 3/1993 | Japan . |
| 10-186860 | 7/1998 | Japan . |

*Primary Examiner*—Sandra Brase
*Attorney, Agent, or Firm*—Oblon, Spivak, McClelland, Maier & Neustadt, P.C.

[57] ABSTRACT

An image forming apparatus including a rotatable image supporter having photoconductive properties, an optical image irradiating device configured to irradiate the image supporter with a light beam to form an electrostatic latent image thereon, and a developing device including a developer, which includes a magnetic carrier and a toner, and a developer supporter which bears the developer on the surface thereof and configured to feed the developer to a developing area between the image supporter and the developer supporter to develop the electrostatic latent image, wherein a ratio of a toner content in a first portion of the developer in the developing area relatively close to the surface of the image supporter to a toner content in a second portion of the developer in the developing area relatively close to the surface of the developer supporter is not less than about 0.6, measured when the developer contacts a continuous non-image area formed on the image supporter.

30 Claims, 8 Drawing Sheets

IMAGE FORMING APPARATUS

BACKGROUND OF THE INVENTION

1. Field of the Invention

The present invention relates to an image forming apparatus, and more particularly to an image forming apparatus in which toner images are formed according to image data using electrophotography.

2. Discussion of the Background

A variety of image forming apparatus such as digital copiers, printers, and facsimile machines have been in practical use. Requests of customers for these image forming apparatus are to have good reliability (i.e., good durability), a low cost, good operation ability, and to produce images having good image qualities.

Among various constitutional devices of such image forming apparatus, developing devices have a great influence on these properties. Among various developing methods using a dry toner for use in image forming methods using electrophotography and the like, two-component developing methods are preferable because of having high-speed developing ability. Therefore, the two-component developing methods are mainly used for image forming apparatus such as copiers and laser printers as a main device.

A typical two-component developing method is as follows:

(1) a two-component developer including a toner and a carrier is supplied to a non-magnetic surface of a developer supporter inside of which a magnet is provided so that the surface of the developer supporter can hold the developer like a brush (hereinafter this brush is referred to as a magnetic brush);

(2) the magnetic brush is brought into contact with or set closely to an image supporter while an electric field is formed between the image supporter and the developer supporter by applying a bias to the developer supporter; and (3) the toner is selectively adhered to electrostatic latent images formed on the image supporter, resulting in formation of toner images on the image supporter. Thus, developing is performed.

A two-component developer includes a toner and a carrier. The carrier is magnetic so as to be held and fed on the surface of a developer supporter by a magnetic force of a magnet set inside the developer supporter. The toner has a charge due to the friction with the carrier, and is adhered to the carrier surface. The toner on the surface of the carrier, which is fed to the image supporter having electrostatic latent images, is transferred onto the image supporter according to the electrostatic latent images. In general, new toner equal to the amount of the toner exhausted by developing electrostatic latent images is compensated to the developer and mixed with the carrier, which remains in the developer, and thereby the new toner is charged. The compensated toner is then fed together with the carrier and used for developing electrostatic latent images.

At an area (hereinafter referred to as a developing area) at which an image supporter and a developer (i.e., a magnetic brush) supported on a developer supporter contact, a toner is separated from a carrier to develop an electrostatic latent image, and on the other hand a phenomenon which occurs is that charges whose polarity is opposite to that of the toner adhered to the carrier attract the toner adhered to the image supporter by a coulomb force, resulting in re-adhesion of the toner on the image supporter to the carrier. Therefore, a problem which occurs is that a scratched solid image is formed or the rear portion of a rectangular solid image or half tone image is omitted.

In addition, recently a need exists for high density images (i.e., images having a large amount of information), and therefore electrostatic latent images also have a high density. When such high density electrostatic latent images having, for example, a diameter of about 50 $\mu$m are developed with a conventional two-component developer, it is difficult to form a toner image having the same dot size, and therefore the resultant toner image has unsatisfactory resolution.

In two-component developing methods, a variety of developing methods, in which a periodic electric field is formed between a developer supporter and an image supporter by applying to the developer supporter a periodically-changing bias (hereinafter referred to as an AC bias) to improve developing ability and image qualities of developed toner images, have been proposed and practically used.

For example, Japanese Laid-Open Patent Publication No. 6-348117 discloses an image forming apparatus in which the conditions of an applied AC bias are changed depending on original images to be reproduced to optimize reproduction of half tone images. In addition, Japanese Laid-Open Patent Publication No. 7-114223 discloses an image forming method in which high quality toner images can be formed by developing digital latent images with a developer, which includes a carrier and a toner and each of which has a small diameter, while applying an AC bias having a high frequency to the developer supporter. It is described in the publication that by using such an image forming method, background fouling, reproducibility of characters, unevenness of solid images, and omission of a rear edge portion of half tone images can be improved and toner images having good image qualities, which are the same as or better than those of photographic images or print images can be obtained.

However, these image forming apparatus and method have the following problem. When an AC bias is applied, a problem which occurs is that white spots are formed in the resultant toner images. The reason is considered to be that discharging occurs locally between the developer supporter and the image supporter due to large potential difference therebetween, and a part of the electrostatic latent images to be developed is discharged, resulting in formation of white spots in the resultant toner images. This will be explained referring to FIG. 8. As can be understood from FIG. 8, the greater the potential difference, $V_{pu}-V_L$, between the highest potential $V_{pu}$ in the potential of the developer supporter and the lowest potential in the potential $V_L$ of the image supporter, the higher the probability of occurrence of white spots in the resultant toner images. In FIG. 8, characters $V_D$ and $V_L$ denote a potential of a non-image area of the image supporter which is not exposed to light and a potential of an image area of the image supporter which is exposed to light, respectively.

In addition, these image forming apparatus and method have another problem in that the rear edge of a solid image is omitted without being developed (hereinafter this problem is referred to as rear edge omission). FIG. 9 is a schematic view illustrating how the rear edge omission occurs. In FIG. 9, an image supporter 14 and a developer supporter 31 move in a direction indicated by an arrow a and a direction shown by an arrow b, respectively. The linear speed of the developer supporter 31 is set to be faster than that of the image supporter 14 to supply a large amount of developer to the image supporter 14, which results in increase of image density of the resultant toner images. Therefore, the magnetic brush (i.e., the developer) on the developer supporter 31 develops electrostatic latent images on the image supporter 14 while overtaking the electrostatic latent images. Under such conditions, when the magnetic brush contacts a non-image area of the image supporter 14 at an upstream side of the developing area, the toner located in the top portion of the magnetic brush is released from the surface of the image supporter 14 by a force in a direction toward the developer supporter 31, which is shown by an arrow c, due to the electric field formed in the developing area. Therefore, the longer the time during which the magnetic brush contacts non-image areas of the image supporter 14, the toner content in a portion of the magnetic brush near the image supporter 14 decreases. When such a magnetic brush moves toward a downstream side of the developing area and contacts an image area of the image supporter 14, toner on the rear edge of the image area, which has been developed with the toner, is electrostatically attracted to the magnetic brush as shown by an arrow d. Therefore, the toner at the rear edge of the image area is omitted. Thus the rear edge omission problem occurs. On the other hand, the toner content of the top portion of the magnetic brush increases again. Even when such a magnetic brush further moves toward a more downstream side, the magnetic brush does not attract the developed toner.

In addition, when an AC bias is applied, a force is at work from the image supporter 14 toward the developer supporter 31 due to the potential difference $V_{PL}-V_D$ between a minimum potential $V_{PL}$ of the developer supporter 31 and the highest potential $V_D$ (i.e., the potential of a non-image area) of the image supporter 14. Therefore, the rear edge omission further worsens.

Because of these reasons, a need exists for an image forming apparatus in which high density toner images can be clearly reproduced without producing undesired images such as rear edge omission.

SUMMARY OF THE INVENTION

Accordingly, an object of the present invention is to provide an image forming apparatus in which high density toner images having good resolution and evenness can be produced.

Another object of the present invention is to provide an image forming apparatus which can produce images without rear edge omission.

Briefly these objects and other objects of the present invention as hereinafter will become more readily apparent can be attained by an image forming apparatus including a rotatable image supporter having photoconductive properties, an optical image irradiating device configured to irradiate the image supporter, which has been charged, with a light beam controlled according to image data, to form an electrostatic latent image thereon, and a developing device including a developer, which includes a toner and a magnetic carrier, and a developer supporter which bears the developer on the surface thereof and configured to feed the developer to a developing area to develop the electrostatic latent image on the image supporter, wherein a ratio of a toner content in a first portion of the developer in the developing area relatively close to the surface of the image supporter to a toner content in a second portion of the developer in the developing area relatively close to the surface of the developer supporter is not less than about 0.6, measured when the developer contacts a continuous non-image area formed on the image supporter.

The width (hereinafter sometimes referred to a developing nip width) of the developing area on the image supporter in a rotating direction is preferably from 5 times to 100 times the average particle diameter of the magnetic carrier, the gap between the surface of the image supporter and the surface of the developer supporter is not less than 5 times the average particle diameter of the magnetic carrier, and the average particle diameter of the magnetic carrier is not greater than the diameter of the light beam.

By controlling the toner content ratio, and determining the diameter of the magnetic carrier depending on the developing width, the gap (hereinafter referred to as a developing gap) between the surface of the image supporter and the surface of the developer supporter and the diameter of the light beam used, high density electrostatic latent images can be faithfully reproduced, and the resultant toner images have good resolution and good evenness without causing rear edge omission.

Preferably, the magnetic carrier has a carrier-particles -ranging part (hereinafter referred as a carrier chain) on an upstream side in the developing area relative to the direction of the image supporter.

The average particle diameter of the magnetic carrier is preferably from about 30 to about 60 $\mu$m.

At this point, the diameter of the light beam is defined as the diameter (hereinafter sometimes referred to as a minimum diameter) of a spot in a light beam, inside of which the intensity of the light is not less than $1/e^2$ times the peak value of intensity of the light beam.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention will be explained referring to drawings.

Figure 1:
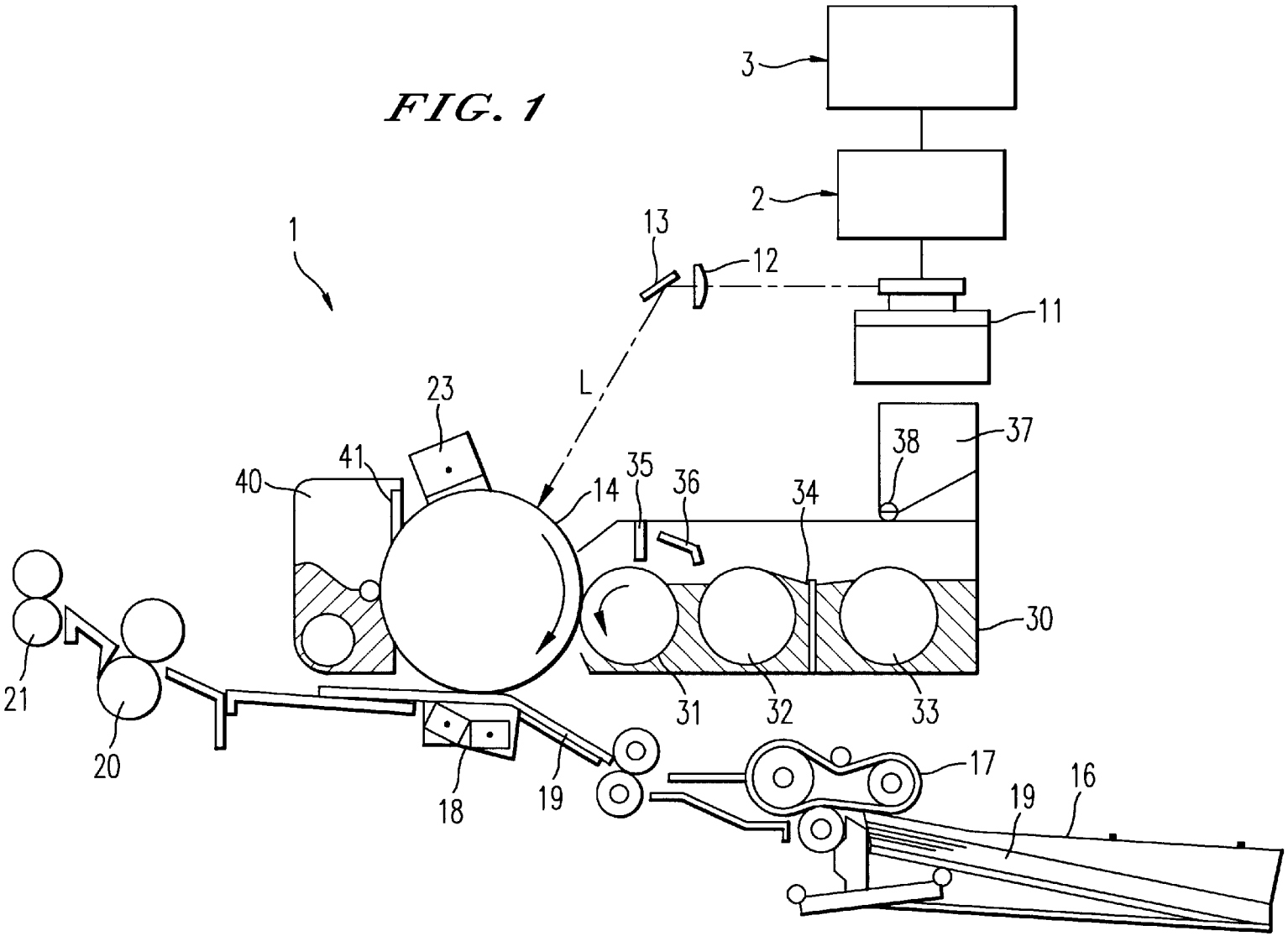
FIG. 1 is a schematic view illustrating a main part of an embodiment of the image forming apparatus.

FIG. 1 is a schematic view illustrating an image forming part of an embodiment of the image forming apparatus of the present invention, such as a printer in which images are formed according to image data sent from apparatus such as computers. In FIG. 1, image data are sent from a computer 3 to a controller 2 to control on/off switching of laser light. Laser light L irradiates an image supporter 14 in a toner image forming section 1 to form an electrostatic latent image on the image supporter 14. The image supporter 14, on the surface of which an organic photoconductor (OPC) layer is formed, rotates in a direction indicated by an arrow. A charger 23 is provided along the surface of the image supporter 14 to charge the surface of the image supporter 14. The charged image supporter 14 is then exposed to laser light L, which is radiated by an optical image irradiating device 11 and passes through a lens 12 and reflected by a mirror 13, to form an electrostatic latent image. The electrostatic latent image is developed with a toner included in a developing device 30 to form a toner image on the image supporter 14. The toner image is then transferred by a transfer device 18 on a transfer material 19, which is previously contained in a cassette 16 and fed by a feeder 17. The transferred toner image on the transfer material 19 is fixed with a fixing device 20 after the transfer material 19 is separated from the image supporter 14, resulting in formation of a hard copy. The hard copy is then discharged by a pair of rollers 21. The image supporter 14 is cleaned with a cleaner 41 in a cleaning device 40 after the toner image transferring process. The surface potentials of an area of the image supporter 14, which is exposed to laser light, and an area of the image supporter 14, which is not exposed to laser light L, are, for example, from −100 V to −200 V and from −600 V to −900 V, respectively. A developing bias of from −300 V to −500 V is applied to a developer supporter 31 so that the toner selectively adheres to the area which is exposed to laser light. Thus, a reverse development is performed.

Figure 2:
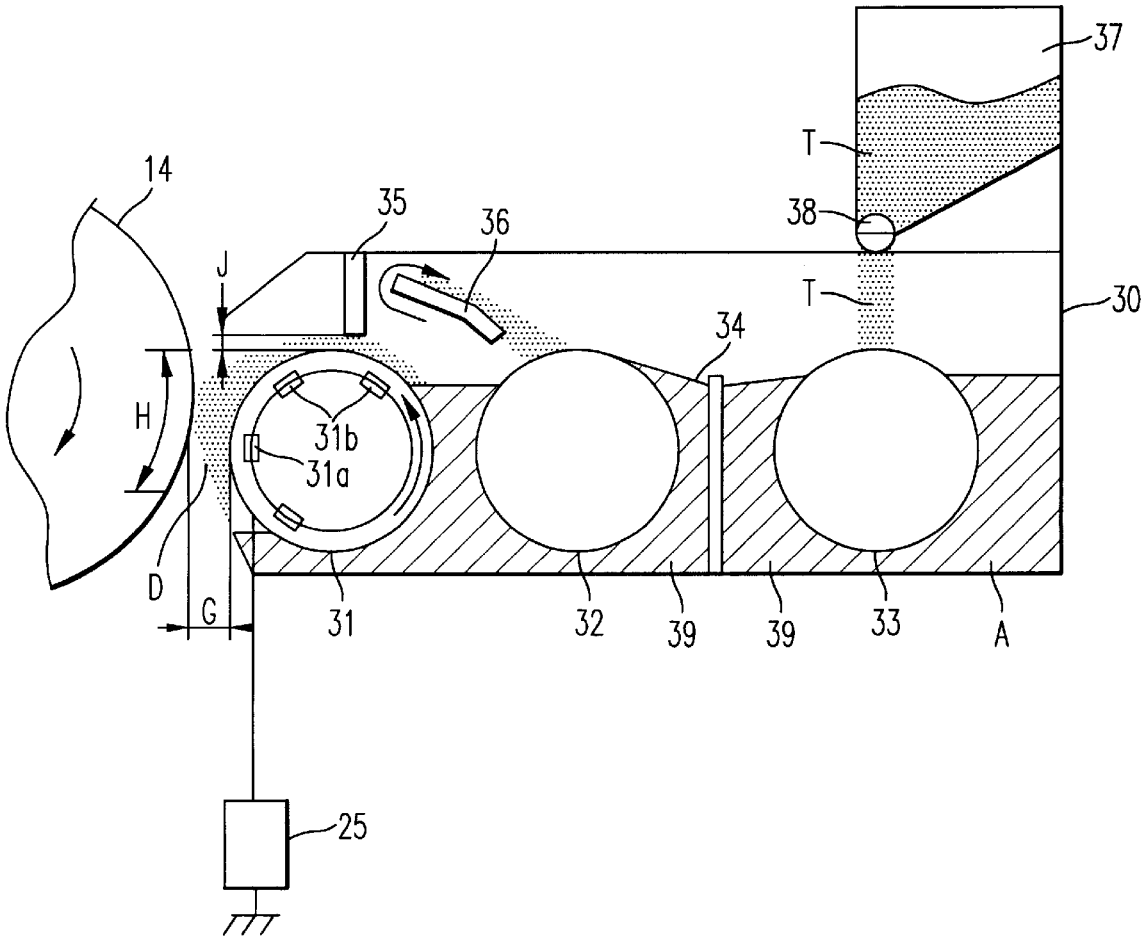
FIG. 2 is a schematic view illustrating an enlarged cross section of the developing device of the image forming apparatus shown in FIG. 1.

FIG. 2 is a schematic view illustrating an enlarged cross section of the developing device of the image forming apparatus shown in FIG. 1. A developing device 30 includes the developer supporter 31, a developer regulating member 35, internal magnets 31*a* and 31*b*, mixing members 32 and 33. The developer supporter 31 is made of a non-magnetic electroconductive material, and the surface of the developer supporter 31 is appropriately roughened by, for example, a sandblast method. The developer supporter 31 rotates in a direction indicated by an arrow, and a plurality of fixed magnets 31*a* and 31*b* are provided inside the developer supporter 31. A developing bias is applied to the developer supporter 31 by a power source 25. The two mixing members 32 and 33 are provided in a developer container 39. The mixing members feed a developer A such that the moving direction of the developer fed by the movement of the mixing member 32 is opposite to the moving direction of the developer fed by the movement of the mixing member 33. A partition 34 is provided in the developer container 39. The developer regulating member 35 is provided near the developer supporter 31 to control the quantity of the developer A to be supplied to a developing area D. Numeral 36 denotes a separator.

A toner T is supplied with a toner supplying roller 38 from a toner bottle 37 to the developer container 39 to compensate the toner used for developing electrostatic latent images. The toner T supplied to the developer container 39 is then mixed with the developer A in the developer container 39. The mixed developer A is fed to the developer supporter 31 by the mixing members 32 and 33, and is then attracted to the developer supporter 31 by a magnetic force of the magnet 31*b*. Since there occurs convection of the developer A under the developer supporter 31 and the mixing member 32, the toner T and the carrier are mixed, and thereby the toner T is sufficiently and uniformly charged.

There is a gap J between the developer regulating member 35 and the developer supporter 31 to feed a predetermined amount of the developer A to the developing area D. The developing area D is defined as an area between the image supporter 14 and the developer supporter 31 in which the toner T in the developer A can move toward electrostatic latent images formed on the image supporter 14. In the developing area D, a magnetic brush, which is formed on the developer supporter 31 and which is formed of the developer A by a magnetic force of the magnets 31*a* and 31*b*, contacts the image supporter 14, and the toner T in the developer A is transferred toward the image supporter 14 by an electric field caused by the voltage applied to the developer supporter 31 and the potential of the electrostatic latent images formed on the image supporter 14.

The developer A includes a carrier which is made, for example, by coating a silicone resin on the surface of ferrite particles (i.e., a core material) having a particle diameter of about 50 μm. The developer A also includes a toner which, for example, includes a thermoplastic resin as a main component in which a colorant such as carbon black is dispersed. The toner preferably has a weight average particle diameter of about 7.5 μm. The content of the toner T in the developer A is preferably from 2% to 20% by weight, and more preferably from 3% to 10% by weight.

Specific examples of the core materials of the carrier include magnetic materials such as iron powders, ferrite, and magnetite. These core materials are preferably coated with a resin such as acrylic resins, silicone resins, and fluorine containing resins. In addition, particulate resin carriers which are made by dispersing a magnetic powder such as magnetite and the like in a binder resin such as acrylic resins may be used as a carrier. The resistance of the carrier can be appropriately controlled by changing the species and/or thickness of the resin coated on the core material of the resin coated carrier or by changing the species and/or the quantity of the binder resin of the particulate resin carriers to improve the durability of the carrier. The intensity of magnetization of the carrier is preferably from 20 to 80 emu/g, and more preferably from 30 to 50 emu/g. When the intensity of magnetization is greater than the upper limit, the evenness of developed solid images tends to deteriorate because the resultant carrier particles are strongly bound, resulting in formation of strong carrier chains, and the solid toner images on the image supporter 14 tend to be scratched by the strong carrier chains. In contrast, when the intensity of magnetization is less than the lower limit, the carrier tends to adhere to the image supporter 14, resulting in formation of white spots in the resultant solid toner images formed on the transfer material 19. In addition, the particle diameter of the carrier is preferably from about 30 μm to about 60 μm. When the particle diameter is less than the lower limit, the carrier tends to adhere to the image supporter 14, resulting in formation of white spots in the resultant solid toner images formed on the transfer material 19. When the particle diameter is greater than the upper limit, toner images having good resolution, which correspond to fine electrostatic latent images formed by a laser beam having a small diameter, cannot be obtained.

The toner for use in the present invention can be made, for example, by including a colorant such as inorganic pigments (e.g., carbon black and magnetite), and organic pigments (e.g., copper phthalocyanine and the like), in a resin such as acrylic resins, polyester resins, and epoxy resins. In addition, additives such as charge controlling agents, waxes, and the like can be added to the toner to improve various properties of the toner. Further, a metal oxide such as silica, alumina and the like can be added to the toner to improve fluidity of the toner. A suitable carrier and toner should be selected from the carriers and toners mentioned above depending on the polarity of the electrostatic latent images formed on the image supporter 14, and developing conditions such as developing speed of the image supporter 14.

In the image forming apparatus of the present invention, a ratio (hereinafter referred to as a toner content ratio) of a toner content in a portion of the developer in the developing area, which is relatively close to the surface of the image supporter, to a toner content in a portion of the developer in the developing area, which is relatively close to the surface of the developer supporter, is not less than 0.6, which is measured when the developer contacts a continuous non-image area formed on the image supporter. At this point, the non-image area is charged so as to have a potential of from −600 to −900 V as mentioned above.

The factors in determining the toner content ratio include a moving speed of the magnetic brush, a curvature of the image supporter 14 and the developer supporter 31, a friction force formed between the image supporter 14 and the magnetic brush, the gap (a gap G in FIG. 2) between the image supporter 14 and the developer supporter 31, the strength of the magnetic field formed in the developing area, the intensity of magnetization of the magnetic carrier, the particle diameter of the developer etc. By controlling these factors, the toner content ratio falls in the preferable range.

The toner content ratio is determined as follows:

(1) A rotating image supporter 14 is charged so as to have the same potential as that of non-image area, while a developing bias is applied to the developer supporter 31, which is also rotated.

(2) The rotation of the image supporter 14 and the developer supporter 31 is stopped.

(3) The image supporter 14 is separated from the developing supporter 31 to identify the area of the magnetic brush at which the magnetic brush contacts the image supporter. The area of the magnetic brush at which the magnetic brush contacts the image supporter can be identified by visual observation because the area is deformed like the surface of the image supporter 14.

(4) The magnetic brush (i.e., the developer A) on the developer supporter 31 other than the deformed area is then removed therefrom with a magnet and the like so that only the developer in the developing area remains on the developer supporter 31.

(5) A thin film is inserted in the developer remaining in the developing area so that the developer is divided into two portions in the vertical direction of the developer.

(6) The portion of the developer, which is positioned on the thin film, i.e., the portion far from the surface of the developer supporter 31, is collected by a magnet and the like.

(7) The toner content of the collected developer (i.e., the developer relatively close to the surface of the image supporter 14) is determined. A blow-off method, which is a known method, is used for determining the toner content in the collected developer.

(8) The toner content of the portion of the developer remaining on the developer supporter 31 (i.e., the developer relatively close to the surface of the developer supporter 31) is also determined in the same way as mentioned above.

Thus, the ratio of the toner content of the developer near the surface of the image supporter 14 to that of the developer near the developer supporter 31 can be determined. In addition, this measuring should be repeated several times, and the data which is obtained when the ratio of the weight of the developer relatively close to the surface of the image supporter 14 to the weight of the developer relatively close to the surface of the developer supporter 31 is about 1:1 is preferably selected.

Figure 9:
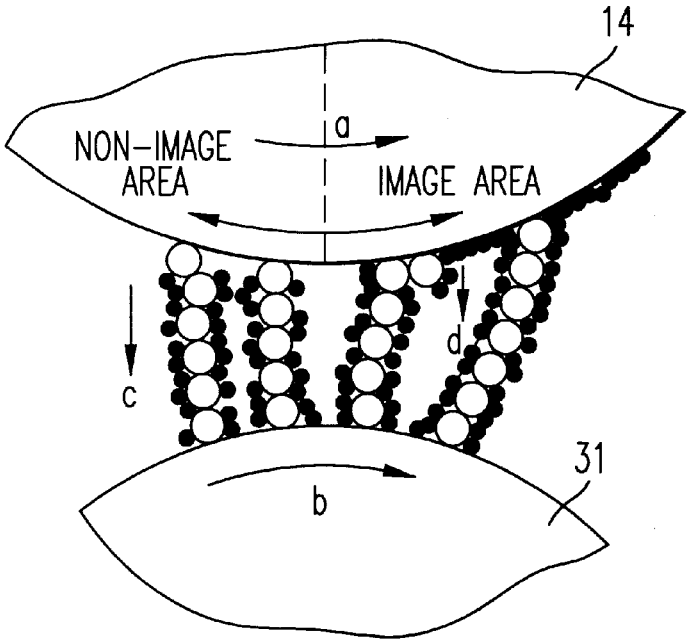
FIG. 9 is a schematic view illustrating how the rear edge omission occurs.

FIG. 9 illustrates a state of the developing area in which the toner content ratio is relatively low. Namely the toner, which has been in the portion of the developer relatively close to the image supporter 14 moves toward the developer supporter side due to the potential of the non-image area of the image supporter 14. When the portion of the developer contacts an image area of the image supporter 14 at a downstream side of the developing area, the portion of the developer electrostatically attracts the toner of a developed toner image, resulting in formation of rear edge omission.

Figure 3:
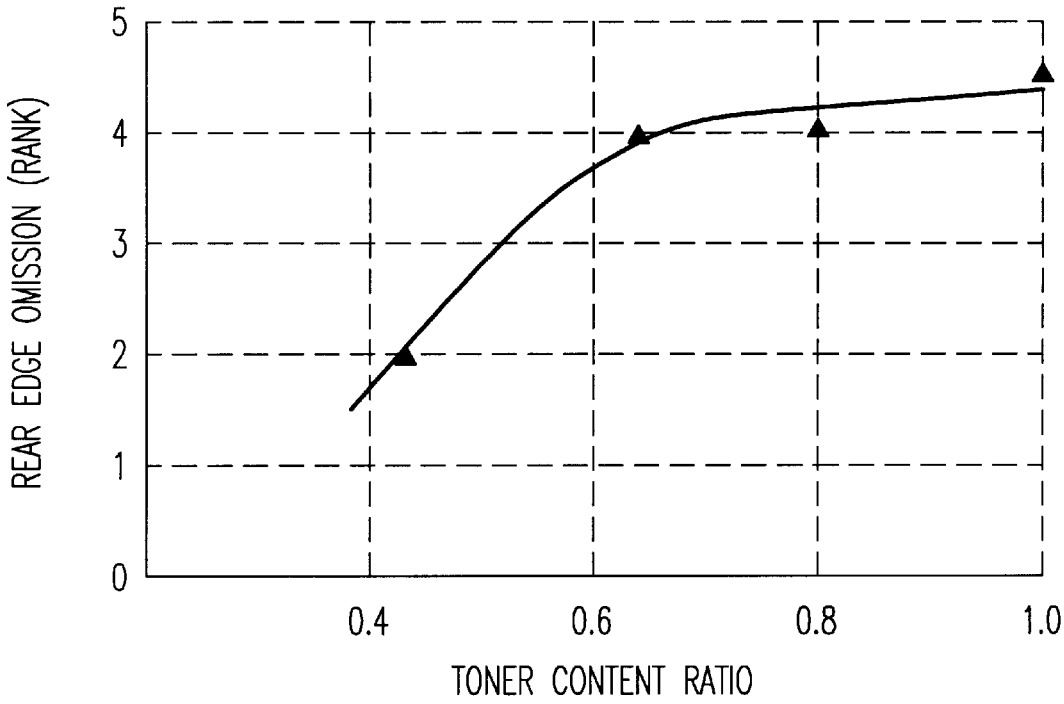
FIG. 3 is a graph illustrating the relationship between the toner content ratio in the developer at the developing area and the level of rear edge omission of the resultant toner image.

FIG. 3 is a graph illustrating the relationship between the toner content ratio and the rear edge omission of the resultant image. The rear edge omission is evaluated by visual observation and the unit thereof is a rank. At this point, rank 5 is the best level in which no rear edge omission is observed in a toner solid image. Rank 1 is the worst level in which serious rear edge omission is observed in a toner solid image. Ranks 2–4 are the intermediate levels therebetween. In the experiment, the toner content ratio is changed by changing the amount of the developer A supplied to the developing area by adjusting the doctor gap J. As can be understood from FIG. 3, when the toner content ratio is less than about 0.6, rear edge omission tend to occur.

In the present invention, the width of the developing area of the image supporter 14 in a rotating direction is preferably from 5 times to 100 times the average particle diameter of the magnetic carrier used. This will be explained referring to FIG. 4.

Figure 4:
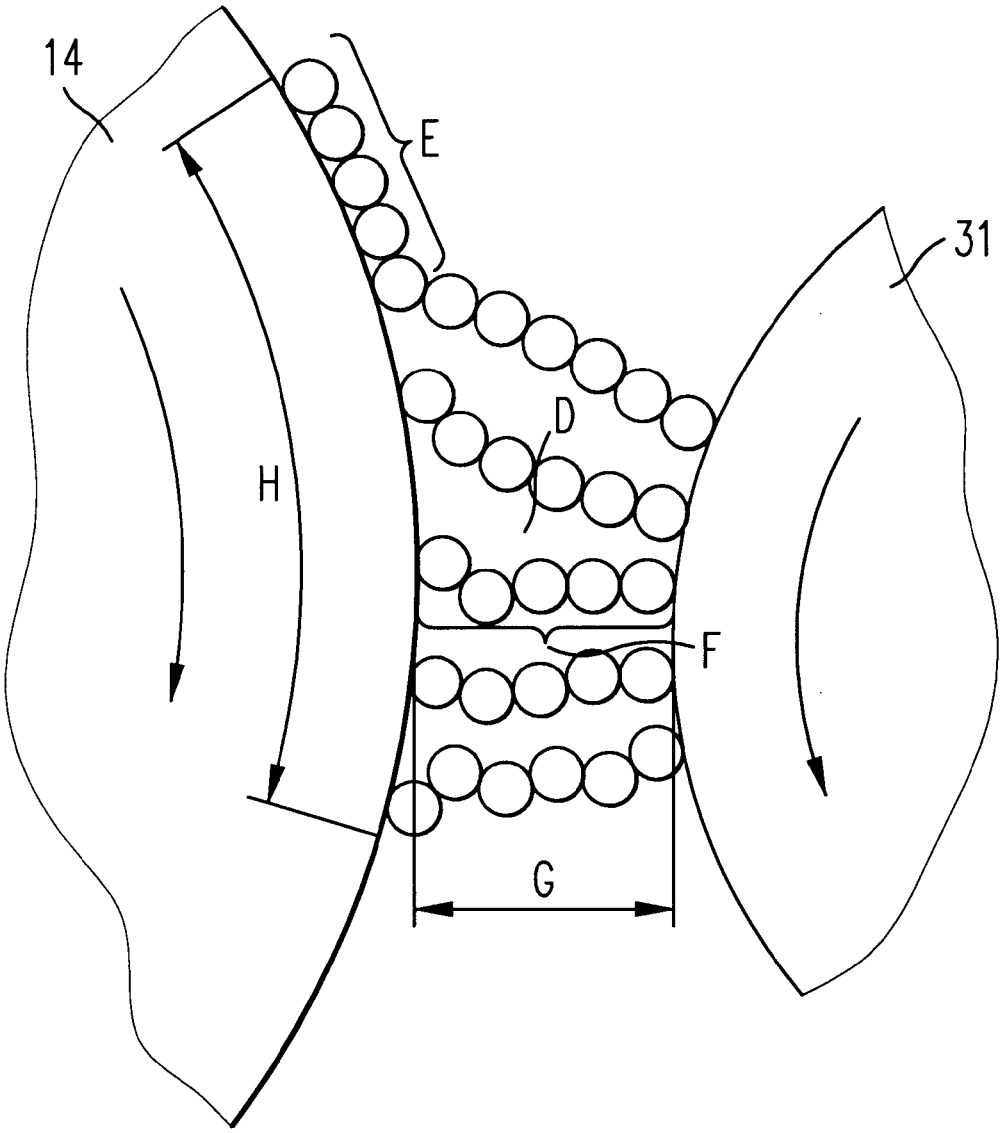
FIG. 4 is a schematic view illustrating a carrier chain at a developing area in the developing device of the image forming apparatus of the present invention.

The present inventor prepares a transparent acrylic drum which has the same size as the image supporter 14 and which serves as a substituent of the image supporter 14, and sets a video camera inside the transparent drum to observe the movement of the developer A in the developing area D. The developing nip width H depends on the amount of the developer A fed to the developing area D and a gap G (hereinafter referred to as a developing gap) between the image supporter 14 and the developer supporter 31. The present inventor made an experiment in which the amount of the developer A fed to the developing area D was changed by adjusting the gap J (hereinafter referred to as a doctor gap) to change the resultant toner images, and the developing area was observed using the transparent drum. The result is schematically shown in FIG. 4. It is found by this observation that when 5 to 100 carrier particles contact the image supporter 14 in the rotating direction of the image supporter 14, good developing is performed, i.e., good images can be obtained. In FIG. 4, characters E and F denote a carrier chain formed on an upstream side of the developing area, and a carrier chain in the developing gap G, respectively, and arrows indicate the rotating directions of the image supporter 14 and the developer supporter 31.

When the number of particles of the carrier contacting the image supporter 14 in the rotating direction of the image supporter 14 is less than 5, the developing capacity of the developer A deteriorates, resulting in occurrence of problems in that the image density of the resultant images decreases and line images are developed like broken lines. In contrast, when the number of particles of the carrier is greater than 100, the magnetic brush tends to scratch the developed toner images, resulting in formation of white streams on the resultant solid images. In addition, a problem which occurs is that the surface of the image supporter 14 is scratched in a long term image forming operation, resulting in shortening of life of the image supporter 14.

In the present invention, it is preferable that carrier chains E are formed on an upstream side in the developing nip area H relative to the rotating direction of the image supporter. Such a developing condition can be achieved by supplying a sufficient amount of the developer A to the developer nip area H and adjusting the magnetic field formed by the magnet 31*a* inside the developer supporter 31. Since the influence of the magnet 31*a* to the carrier chains is not large, the carrier chains can relatively freely move on the surface of the image supporter 14 in a direction perpendicular to the rotating direction of the image supporter 14. Therefore, the toner adhered to the carrier can uniformly adhere to the latent images on the image supporter 14, which results in cancellation of the unevenness of the toner images caused by the magnetic brush. Thus, by forming carrier chains in the developing nip area H, images having better evenness can be obtained.

In addition, in the present invention, the gap G between the image supporter 14 and the developer supporter 31 is not less than 5 times the average particle diameter of the magnetic carrier used. This will be explained referring to FIG. 4.

When the developing gap G is changed while the number of the carrier particles contacting the surface of the image supporter 14 is controlled so as to be constant by controlling the doctor gap J, it is found that image qualities largely change depending on the number of the carrier chain F in the developing gap G.

When the number of the carrier particles of the carrier chain F is not greater than 4, the resultant magnetic brush (i.e., a brush of the developer A) becomes hard and scratches developed toner images, resulting in formation of white streaks in the resultant toner images. In addition, a problem which occurs is that the surface of the image supporter 14 is scratched in a long term image forming operation, resulting in shortening of life of the image supporter 14. It is also found that the more the number of the carrier particles of the carrier chain F, the better the image qualities (in particular, evenness of solid images and resolution) of the resultant toner images. This is because the resultant magnetic brush has a constant and appropriate rubbing force.

Further, in the present invention, the average particle diameter of the magnetic carrier used is less than the diameter of the laser beam used for forming an electrostatic latent dot image.

Figure 5A:
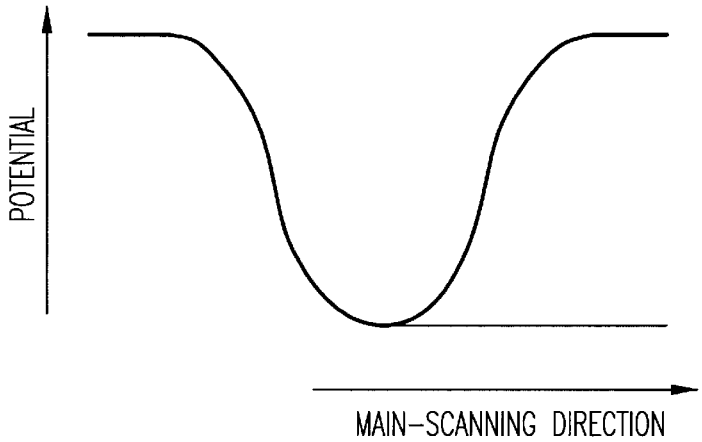
FIGS. 5A and 5B are graphs in which a distribution of potential of an image carrier is shown when the image carrier is exposed to a laser beam having a relatively large diameter (5A) or a relatively small diameter (5B)
Figure 5B:
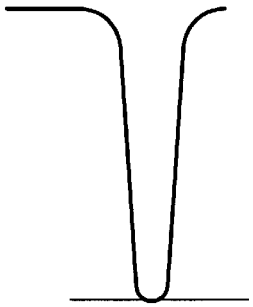

Electrostatic latent images are formed by irradiating the charged image supporter 14 with a laser beam. FIGS. 5A and 5B illustrate a potential distribution of an electrostatic latent dot image formed on the image supporter 14 by irradiation of a laser beam. As shown in FIG. 5B, when a laser beam having a relatively small diameter is used, the resultant electrostatic latent dot image has a relatively small diameter (i.e., a relatively small area). In contrast, as shown in FIG. 5A, when a laser beam having a relatively large diameter is used, the resultant electrostatic latent dot image has a relatively large diameter (i.e., a relatively large area).

Figure 6A:
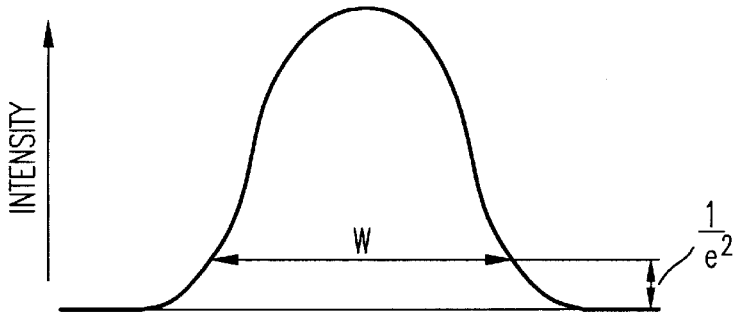
FIGS. 6A and 6B are graphs showing how to define the diameter of a light beam when the diameter of the light beam is relatively large (6A) or relatively small (6B)
Figure 6B:
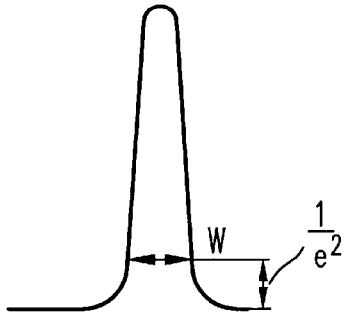

FIGS. 6A and 6B illustrate a distribution of intensity of a laser beam having a relatively large or small diameter. In the present invention, the diameter of a laser beam is defined as the diameter of a spot in the laser beam, inside of which the intensity of the laser light is not less than $1/e^2$ times the peak value of intensity of the intensity of the laser beam. Namely, the diameter of a laser beam is represented as character W in FIGS. 6A and 6B. When the diameter of a laser beam is thus defined, the smallest electrostatic latent dot image has almost the same diameter as the diameter of the laser beam used.

In order to form a clear dotted toner image which corresponds to an electrostatic latent dot image, it is needed to use a carrier having a diameter almost the same as or smaller than the diameter of the latent dot image.

Furthermore, in the present invention, the average particle diameter of the magnetic carrier is preferably from about 30 $\mu$m to about 60 $\mu$m.

Figure 7A:
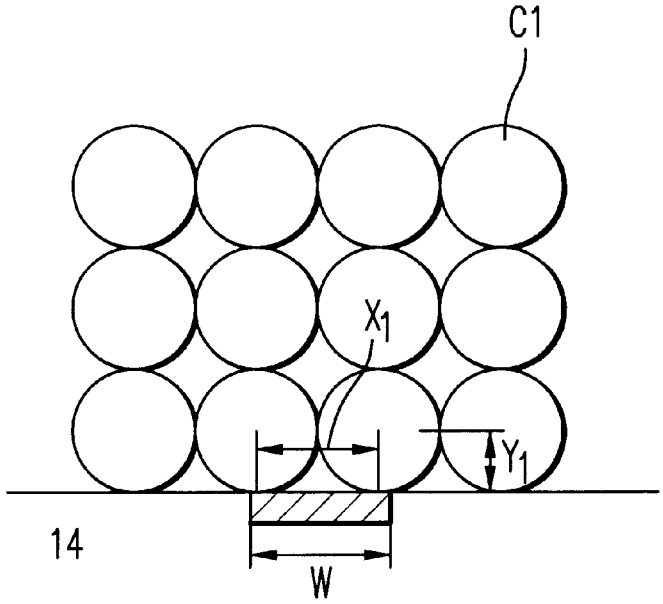
FIGS. 7A and 7B are schematic views illustrating how developing is performed when the particle diameter of the carrier used is relatively large (7A) or relatively small (7B)
Figure 7B:
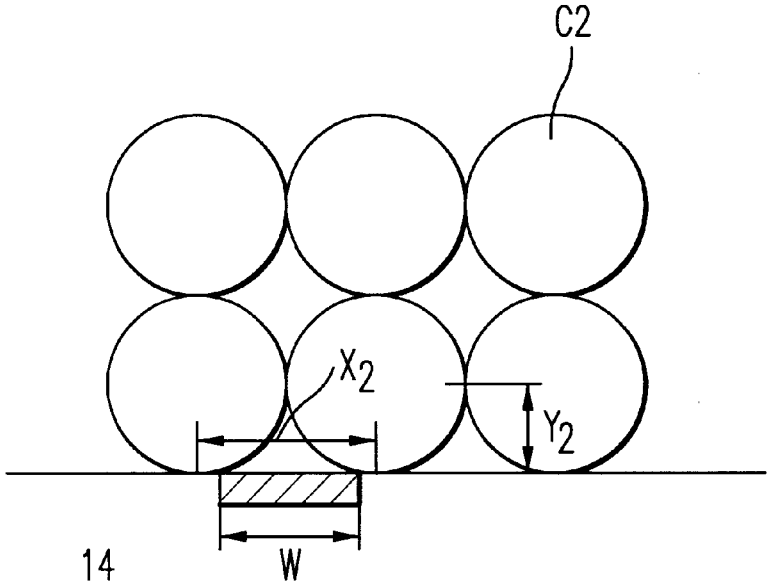
Figure 8:
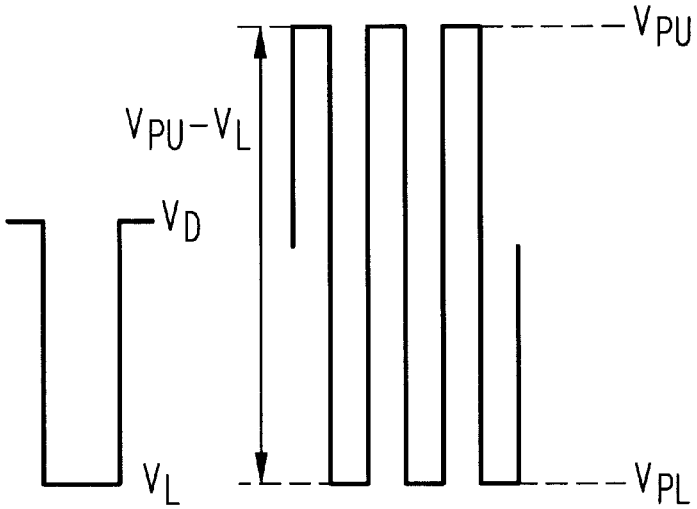
FIG. 8 is a schematic view illustrating the potentials of an image part and a non-image area on the image supporter, and the potential of an AC bias applied to the developer supporter.

FIGS. 7A and 7B are schematic views illustrating the developing nip area in which relatively large or small carrier particles contact the image supporter 14. As shown in FIG. 7B, when relatively large carrier particles are used, there are relatively large areas on the developing nip area in which carrier particles do not contact the image supporter 14 and which are represented by X2, even when the carrier particles have a close-packed structure. In FIG. 7B, since X2 is larger than the diameter W of the laser beam used and the height Y2 is relatively large, toner particles hardly adhere to the area X2, and therefore reproduction of relatively small dot images deteriorates and the resultant solid toner images have poor evenness. In FIG. 7A, since X1 is smaller than the diameter W of the laser beam used and the height Y1 is relatively small, toner particles easily adhere to the area X1 by the influence of the electric field formed between the image supporter 14 and the developer, resulting in formation of images having good image qualities.

It is also found by the experiment that when the particle diameter of the carrier used is smaller than the diameter W of the laser beam used, the smallest electrostatic latent dot image, which is formed by the laser beam, can be developed. When the particle diameter is greater than the diameter W of the laser beam used, the diameter of the resultant smallest toner dot images varies, resulting in deterioration of evenness of the resultant toner images. In contrast, when the average particle diameter of the magnetic carrier is too small, the intensity of magnetization of a particle of the magnetic carrier becomes weak, resulting in adhesion of particles of the magnetic carrier chain to the image supporter 14. In addition, the toner present near the surface of the image supporter 14 can easily move along the carrier chain, and thereby the toner content ratio tends to decrease. Therefore it is preferable to use a magnetic carrier having an average particle diameter of from about 30 $\mu$m to about 60 $\mu$m.

Having generally described this invention, further understanding can be obtained by reference to certain specific examples which are provided herein for the purpose of illustration only and are not intended to be limiting.

EXAMPLES

Example 1

Toner images consisting of dot images were formed using the image forming apparatus shown in FIG. 1. The developing conditions are shown in Table 1.

TABLE 1

| Element | Item | Condition |
|---|---|---|
| Carrier | Material | Ferrite coated with a resin |
| | Particle diameter | 50 μm |
| Toner | Type | Non-magnetic toner |
| | Particle diameter | 7 μm |
| Image supporter | Rotating speed | 240 mm/s |
| Laser beam | Diameter in a main scanning direction | 60 μm (1.2 times the diameter of the carrier used) |
| | Diameter in a direction of sub-scanning direction | 70 μm (1.4 times the diameter of the carrier used) |
| Developer supporter | Linear speed | 480 mm/s |
| Image supporter | Diameter | 60 mm |
| Developer supporter | Diameter | 20 mm |
| Image supporter | Potential at non-image area | −900 V |
| | Potential at image area | −150 V |
| Developing device | Developing bias | −600 V |

The image qualities of the resultant toner dot images were visually checked while the quantity of the developer fed to the developing area was changed by adjusting the doctor gap J. In addition, the developing nip area was observed using the transparent drum mentioned before.

As a result, toner images having good image qualities could be obtained.

In addition, while adjusting the doctor gap J and developing gap G, the image qualities of the resultant toner dot images were visually checked. Toner images having good image qualities could be obtained by optimizing the doctor gap J and developing gap G.

Comparative Example 1

The procedure for preparation of the toner images in Example 1 was repeated except that an AC developing bias was also applied in addition to the DC developing bias.

The conditions are shown in Table 2.

TABLE 2

| Element | Item | Condition |
|---|---|---|
| Carrier | Material | Ferrite coated with a resin |
| | Particle diameter | 50 μm |
| Toner | Type | Non-magnetic toner |
| | Particle diameter | 7 μm |
| Image supporter | Rotating speed | 240 mm/s |
| Laser beam | Diameter in a main scanning direction | 60 μm (1.2 times the diameter of the carrier used) |
| | Diameter in a direction of sub-scanning direction | 70 μm (1.4 times the diameter of the carrier used) |
| Developer supporter | Linear speed | 480 mm/s |
| Image supporter | Diameter | 60 mm |
| Developer supporter | Diameter | 20 mm |

TABLE 2-continued

| Element | Item | Condition |
|---|---|---|
| Image supporter | Potential at non-image area | −900 V |
| | Potential at image area | −150 V |
| Developing device | Developing bias (DC) | −600 V |
| | Developing bias (AC) | 2000 V |
| | Voltage (Vp-p) | 2 KHz |
| | Frequency | Rectangular |
| | Waveform | |

The images formed in Comparative Example 1 had white spots because there occurred local-discharging in the electrostatic latent images on the image supporter 14.

Comparative Example 2

The procedure for preparation of the toner images in Example 1 was repeated except that the diameter of the carrier was changed to 80 μm.

The conditions are shown in Table 3.

TABLE 3

| Element | Item | Condition |
|---|---|---|
| Carrier | Material | Ferrite coated with a resin |
| | Particle diameter | 80 μm |
| Toner | Type | Non-magnetic toner |
| | Particle diameter | 7 μm |
| Image supporter | Rotating speed | 240 mm/s |
| Laser beam | Diameter in a main scanning direction | 60 μm (0.75 times the diameter of the carrier used) |
| | Diameter in a direction of sub-scanning direction | 70 μm (0.875 times the diameter of the carrier used) |
| Developer supporter | Linear speed | 480 mm/s |
| Image supporter | Diameter | 60 mm |
| Developer supporter | Diameter | 20 mm |
| Image supporter | Potential at non-image area | −900 V |
| | Potential at image area | −150 V |
| Developing device | Developing bias | −600 V |

The image qualities of the toner images were visually checked while the quantity of the developer fed to the developing area was changed by adjusting the doctor gap J. In addition, the developing nip area was observed using the transparent drum mentioned before.

As a result, the evenness of the dot images was not satisfactory because the area of the resultant toner dot images varied.

In addition, it is found by observation that when the developing nip width was shorter than a length of 5 times the particle diameter of the carrier used, developing ability of the developer deteriorates, and thereby the resultant fine line images were broken and the resultant solid images had a relatively low image density. In addition, when the developing nip width was longer than a length of 100 times the particle diameter of the carrier used, the rear edge omission occurred. At this point, when the toner content ratio was measured, the toner content ratio was less than 0.6. When the developing nip width was from 5 to 100 times the average particle diameter of the magnetic carrier, the toner content ratio is not less than 0.6.

In addition, while adjusting the doctor gap J and developing gap G, the image qualities of the resultant toner dot images were visually checked. As a result, toner images having good image qualities could not be obtained because the area of the resultant toner dot images varied even when optimizing the doctor gap J and developing gap G.

It is also found that when the developing gap G was not greater than a length of 4 times the diameter of the carrier used, the resultant solid images had white streaks because the solid images were scratched by the magnetic brush.

Example 2

The procedure for preparation of the toner images in Example 1 was repeated except that the diameter of the carrier was changed to 40 μm, and the diameter of the laser beam used, the potentials of the image supporter and developing bias were changed as shown in Table 4.

The conditions are shown in Table 4.

TABLE 4

| Element | Item | Condition |
|---|---|---|
| Carrier | Material | Ferrite coated with a resin |
| | Particle diameter | 40 μm |
| Toner | Type | Non-magnetic toner |
| | Particle diameter | 7 μm |
| Image supporter | Rotating speed | 240 mm/s |
| Laser beam | Diameter in a main scanning direction | 50 μm (1.25 times the diameter of the carrier used) |
| | Diameter in a direction of sub-scanning direction | 60 μm (1.5 times the diameter of the carrier used) |
| Developer supporter | Linear speed | 480 mm/s |
| Image supporter | Diameter | 60 mm |
| Developer supporter | Diameter | 20 mm |
| Image supporter | Potential at non-image area | −600 V |
| | Potential at image area | −100 V |
| Developing device | Developing bias | −400 V |

The image qualities of the toner images were visually checked while the quantity of the developer fed to the developing area was changed by adjusting the doctor gap J. In addition, the developing nip area was observed using the transparent drum mentioned before.

As a result, toner images having good image qualities could be obtained.

In addition, while adjusting the doctor gap J and developing gap G, the image qualities of the resultant toner dot images were visually checked. Toner images having good image qualities could be obtained by optimizing the doctor gap J and developing gap G.

Comparative Example 3

The procedure for preparation of the toner images in Example 2 was repeated except that the diameter of the carrier was changed to 80 μm.

The conditions are shown in Table 3.

TABLE 3

| Element | Item | Condition |
|---|---|---|
| Carrier | Material | Ferrite coated with a resin |
| | Particle diameter | 80 μm |
| Toner | Type | Non-magnetic toner |
| | Particle diameter | 7 μm |

TABLE 3-continued

| Element | Item | Condition |
|---|---|---|
| Image supporter | Rotating speed | 240 mm/s |
| Laser beam | Diameter in a main scanning direction | 50 μm (0.625 times the diameter of the carrier used) |
| | Diameter in a direction of sub-scanning direction | 60 μm (0.75 times the diameter of the carrier used) |
| Developer supporter | Linear speed | 480 mm/s |
| Image supporter | Diameter | 60 mm |
| Developer supporter | Diameter | 20 mm |
| Image supporter | Potential at non-image area | −600 V |
| | Potential at image area | −100 V |
| Developing device | Developing bias | −400 V |

The image qualities of the toner images were visually checked while the quantity of the developer fed to the developing area was changed by adjusting the doctor gap J. In addition, the developing nip area was observed using the transparent drum mentioned before.

As a result, the evenness of the dot images was not satisfactory because the area of the resultant toner dot images varied.

It is also found by observation that when the developing nip width was shorter than a length of 5 times the particle diameter of the carrier used, developing ability of the developer deteriorates, and thereby the resultant fine line images were broken and the resultant solid images had a relatively low image density. In addition, when the developing nip width was longer than a length of 100 times the particle diameter of the carrier used, the rear edge omission occurred. At this point, when the toner content ratio was measured, the toner content ratio was less than 0.6. When the developing nip width was from 5 to 100 times the average particle diameter of the magnetic carrier, the toner content ratio was not less than 0.6.

In addition, while adjusting the doctor gap J and developing gap G, the image qualities of the resultant toner dot images were visually checked. Toner images having good image qualities could not be obtained because the area of the resultant toner dot images varied even when optimizing the doctor gap J and developing gap G.

It is also found that the developing gap G was not greater than a length of 4 times the diameter of the carrier used, the resultant solid images had white streaks because the solid images were scratched by the magnetic brush.

This document claims priority and contains subject matter related to Japanese Patent Application No. 10-333388, filed on Nov. 10, 1998, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus comprising:

a rotatable image supporter having photoconductive properties;

an optical image irradiating device configured to irradiate the image supporter with a light beam to form an electrostatic latent image on the image supporter; and a developing device including a developer, the developer including a toner and a magnetic carrier, and a developer supporter which bears the developer on a surface thereof and configured to feed the developer to a developing area between the image supporter and the developer supporter to develop the electrostatic latent image on the image supporter, wherein a ratio of a toner content in a first portion of the developer in the developing area relatively close to a surface of the image supporter to a toner content in a second portion of the developer in the developing area relatively close to the surface of the developer supporter is not less than about 0.6, measured when the developer contacts a continuous non-image area formed on the image supporter.

2. An image forming apparatus according to claim 1, wherein a width of the developing area on the image supporter in a rotating direction is from 5 times to 100 times an average particle diameter of the magnetic carrier.

3. An image forming apparatus according to claim 1, wherein a gap between a surface of the image supporter and a surface of the developer supporter is not less than 5 times an average particle diameter of the magnetic carrier.

4. An image forming apparatus according to claim 1, wherein the magnetic carrier has an average particle diameter not greater than a diameter of the light beam.

5. An image forming apparatus according to claim 1, wherein carrier chains are formed on an upstream side of the image supporter in the developing area relative to the rotating direction of the image supporter.

6. An image forming apparatus according to claim 1, wherein the magnetic carrier has an average particle diameter of from about 30 $\mu$m to about 60 $\mu$m.

7. An image forming apparatus comprising:

a rotatable image supporter configured to bear an electrostatic latent image thereon; and a developer supporter configured to bear a developer, the developer including a magnetic carrier and a toner, on a surface thereof and configured to feed the developer to a developing area between the image supporter and the developer supporter to develop the electrostatic latent image on the image supporter, wherein a ratio of a toner content in a first portion of the developer in the developing area relatively close to the surface of the image supporter to a toner content in a second portion of the developer in the developing area relatively close to a surface of the developer supporter is not less than about 0.6, measured when the developer contacts a continuous non-image area formed on the image supporter.

8. An image forming apparatus according to claim 7, wherein a width of the developing area on the image supporter in a rotating direction is from 5 times to 100 times an average particle diameter of the magnetic carrier.

9. An image forming apparatus according to claim 7, wherein a gap between a surface of the image supporter and a surface of the developer supporter is not less than 5 times an average particle diameter of the magnetic carrier.

10. An image forming apparatus according to claim 7, wherein the magnetic carrier has an average particle diameter not greater than a diameter of a minimum dot of the electrostatic latent image.

11. An image forming apparatus comprising:

image bearing means for bearing an electrostatic latent image thereon;

optical image irradiating means for irradiating the image bearing means with a light beam to form the electrostatic latent image thereon; and developer supporting means for bearing a developer, the developer including a magnetic carrier and a toner, on a surface thereof and for feeding the developer to a developing area between the image bearing means and the developer supporting means to develop the electrostatic latent image on the image bearing means, wherein a ratio of a toner content in a first portion of the developer in the developing area relatively close to a surface of the image bearing means to a toner content in a second portion of the developer in the developing area relatively close to a surface of the developer supporting means is not less than about 0.6, measured when the developer contacts a continuous non-image area formed on the image bearing means.

12. An image forming apparatus according to claim 11, wherein a width of the developing area on the image bearing means in a rotating direction is from 5 times to 100 times an average particle diameter of the magnetic carrier.

13. An image forming apparatus according to claim 11, wherein a gap between a surface of the image bearing means and a surface of the developer supporting means is not less than 5 times an average particle diameter of the magnetic carrier.

14. An image forming apparatus according to claim 11, wherein the magnetic carrier has an average particle diameter not greater than a diameter of the light beam.

15. An image forming apparatus according to claim 11, wherein carrier chains are formed on an upstream side of the image bearing means in the developing area relative to the rotating direction of the image bearing means.

16. An image forming apparatus according to claim 11, wherein the magnetic carrier has an average particle diameter of from about 30 $\mu$m to about 60 $\mu$m.

17. An image forming apparatus comprising:

image bearing means for bearing an electrostatic latent image thereon; and developer supporting means for bearing a developer, the developer including a magnetic carrier and a toner, on a surface thereof and for feeding the developer to a developing area between the image bearing means and the developer supporting means to develop the electrostatic latent image on the image bearing means, wherein a ratio of a toner content in a first portion of the developer in the developing area relatively close to a surface of the image bearing means to a toner content in a second portion of the developer in the developing area relatively close to a surface of the developer supporting means is not less than about 0.6, measured when the developer contacts a continuous non-image area formed on the image bearing means.

18. An image forming apparatus according to claim 17, wherein a width of the developing area on the image bearing means in a rotating direction is from 5 times to 100 times an average particle diameter of the magnetic carrier.

19. An image forming apparatus according to claim 17, wherein a gap between a surface of the image bearing means and a surface of the developer supporting means is not less than 5 times an average particle diameter of the magnetic carrier.

20. An image forming apparatus according to claim 17, wherein the magnetic carrier has an average particle diameter not greater than a diameter of a minimum dot of the electrostatic latent image.

21. An image forming method comprising the steps of:

charging a rotatable image supporter;

irradiating the image supporter with a light beam to form an electrostatic latent image on the image supporter; and developing the electrostatic latent image at a developing area between the image supporter and a developer supporter with a developer, the developer including a magnetic carrier and a toner, born on the developer supporter, wherein a ratio of a toner content in a first portion of the developer in the developing area relatively close to a surface of the image supporter to a toner content in a second portion of the developer in the developing area relatively close to a surface of the developer supporter is not less than about 0.6, measured when the developer contacts a continuous non-image area formed on the image supporter.

22. An image forming method according to claim 21, wherein a width of the developing area on the image supporter in a rotating direction is from 5 times to 100 times an average particle diameter of the magnetic carrier.

23. An image forming method according to claim 21, wherein a gap between a surface of the image supporter and a surface of the developer supporter is not less than 5 times an average particle diameter of the magnetic carrier.

24. An image forming method according to claim 21, wherein the magnetic carrier has an average particle diameter not greater than a diameter of the light beam.

25. An image forming method according to claim 21, wherein the developing step comprises the substep of:

forming carrier chains on an upstream side of the image supporter in the developing area relative to a rotating direction of the image supporter.

26. An image forming method according to claim 21, wherein the magnetic carrier has an average particle diameter of from about 30 $\mu$m to about 60 $\mu$m.

27. An image forming method comprising the steps of:

charging a rotatable image supporter to form an electrostatic latent image thereon; and developing the electrostatic latent image at a developing area between the image supporter and a developer supporter with a developer, the developer including a magnetic carrier and a toner, born on the developer supporter, wherein a ratio of a toner content in a first portion of the developer in the developing area relatively close to a surface of the image supporter to a toner content in a second portion of the developer in the developing area relatively close to a surface of the developer supporter is not less than about 0.6, measured when the developer contacts a continuous non-image area formed on the image supporter.

28. An image forming method according to claim 27, wherein a width of the developing area on the image supporter in a rotating direction is from 5 times to 100 times an average particle diameter of the magnetic carrier.

29. An image forming method according to claim 27, wherein a gap between a surface of the image supporter and a surface of the developer supporter is not less than 5 times an average particle diameter of the magnetic carrier.

30. An image forming method according to claim 27, wherein the magnetic carrier has an average particle diameter not greater than a diameter of a minimum dot of the electrostatic latent image.

* * * * *